US010351376B2

(12) United States Patent
Bartolini

(10) Patent No.: US 10,351,376 B2
(45) Date of Patent: Jul. 16, 2019

(54) WINDER AND A METHOD FOR WINDING A ROLL FROM A FIBROUS WEB

(71) Applicant: Valmet S.P.A., Milan (IT)

(72) Inventor: Fabrizio Bartolini, Lucca (IT)

(73) Assignee: VALMET S.P.A., Milan (IT)

( * ) Notice: Subject to any disclaimer, the term of this patent is extended or adjusted under 35 U.S.C. 154(b) by 0 days.

(21) Appl. No.: 16/078,264

(22) PCT Filed: Feb. 17, 2017

(86) PCT No.: PCT/EP2017/053608
§ 371 (c)(1),
(2) Date: Aug. 21, 2018

(87) PCT Pub. No.: WO2017/157609
PCT Pub. Date: Sep. 21, 2017

(65) Prior Publication Data

US 2019/0023515 A1 Jan. 24, 2019

(30) Foreign Application Priority Data

Mar. 15, 2016 (EP) ..... 16160363

(51) Int. Cl.
*B65H 18/26* (2006.01)
*B65H 18/02* (2006.01)

(52) U.S. Cl.
CPC ..... *B65H 18/025* (2013.01); *B65H 18/028* (2013.01); *B65H 18/26* (2013.01);
(Continued)

(58) Field of Classification Search
CPC .... B65H 18/025; B65H 18/028; B65H 18/26; B65H 2404/24; B65H 2404/43
See application file for complete search history.

(56) References Cited

U.S. PATENT DOCUMENTS 3,104,845 A * 9/1963 Patterson, Jr. ..... B65H 18/20 242/541.6
3,232,549 A 2/1966 Stambaugh
(Continued)

FOREIGN PATENT DOCUMENTS

DE 102011116308 A1 4/2013
JP H05186115 A 7/1993

OTHER PUBLICATIONS

European Patent Office, Extended European Search Report for Application No. 16160363.4, dated Sep. 30, 2016, 4 pages, Germany.

(Continued)

*Primary Examiner* — Sang K Kim
(74) *Attorney, Agent, or Firm* — Alston & Bird LLP

(57) ABSTRACT

The present invention relates to a w winder (1) for winding a web roll (2) from a fibrous web such as a paper web or a web of non-woven material paper (2). The winder (1) comprises two support rolls (3, 4) for supporting the web roll (2) during reeling and a core shaft (5) for winding the paper reel (2). At each longitudinal end of the core shaft (5), there is a carrier chuck (6) in which the core shaft (5) is rotatably journalled. The carrier chucks to are arranged to be movable in a frame towards or away from the support rolls (3, 4) and a rider roll (8) is arranged to be capable of acting against the web roll (2) being wound. The rider roll (8) is carried by a rider roll beam (9) and the rider roll beam (9) is arranged to be movable in the frame (7) such that the rider roll (8) can be moved towards or away from the support rolls (3, 4). There is at least one actuator (10) for moving the rider roll beam (9) towards or away from the support rolls (3, 4); and at least one load cell (12) arranged to detect the force between the rider roll (8) and the web roll (2). The winder (1) also comprises at least one actuator (11) for moving the carrier chucks (6) of the core shaft (5) independently of the
(Continued)

rider roll beam (9) and the winder (1) comprises at least one load cell (13) arranged to detect the force with which the carrier chucks (6) act on the core shaft (5). The winder (1) also comprises a logic control system (14) connected to the load cells (12, 13) such that the logic control system (14) receives measured values for the force between the web roll (2) and the rider roll (8) and the force with which the carrier chucks (6) act on the core shaft (5). The logic control system (14) is programmed to control movement of the carrier chucks (6) and the rider roll beam (9) such that the sum of the forces detected from the load cells (12, 13) and the force resulting from a calculated weight of the web roll (2) corresponds to a set value for the force between the web roll (2) and the support rolls (3, 4). The invention also relates to a corresponding method for operating the winder.

7 Claims, 8 Drawing Sheets

(52) U.S. Cl.
CPC ..... *B65H 2301/41346* (2013.01); *B65H 2301/41366* (2013.01); *B65H 2301/41374* (2013.01); *B65H 2301/413526* (2013.01); *B65H 2402/24* (2013.01); *B65H 2404/43* (2013.01); *B65H 2408/232* (2013.01); *B65H 2511/13* (2013.01); *B65H 2511/142* (2013.01); *B65H 2511/232* (2013.01); *B65H 2515/34* (2013.01); *B65H 2553/00* (2013.01); *B65H 2557/266* (2013.01); *B65H 2601/22* (2013.01)

(56) References Cited

U.S. PATENT DOCUMENTS

| | | | | |
|---|---|---|---|---|
| 3,568,944 A | | 3/1971 | Besserdich | |
| 3,837,593 A | * | 9/1974 | Dorfel ..... | B65H 18/20 242/534 |
| 3,937,410 A | | 2/1976 | Justus | |
| 4,811,915 A | * | 3/1989 | Smith ..... | B65H 18/20 242/534.2 |
| 5,320,299 A | | 6/1994 | Fitzpatrick et al. | |

OTHER PUBLICATIONS

International Searching Authority, International Search Report and Written Opinion for International Application No. PCT/EP2017/053608, dated May 10, 2017, 14 pages, European Patent Office, Netherlands.

* cited by examiner

WINDER AND A METHOD FOR WINDING A ROLL FROM A FIBROUS WEB

CROSS REFERENCE TO RELATED APPLICATIONS

This application is a National Stage Application, filed under 35 U.S.C. 371, of International Application No. PCT/EP2017/053608, filed Feb. 17, 2017, which claims priority to European Application No. 16160363.4, filed Mar. 15, 2016; the contents of both of which as are hereby incorporated by reference in their entirety.

BACKGROUND

Related Field

The present invention relates to a winder and a method for winding a roll from a paper web such as a paper web or a web of non-woven material.

Description of Related Art

Winders are commonly used for converting purposes when paper rolls that have been produced in a paper machine are converted into narrower rolls and the winder is commonly used in connection with slitters that are used to make the web narrower. An example of a winder is disclosed in U.S. Pat. No. 5,320,299. Winders may have support rolls or support drums on which the paper roll that is being wound is supported. Winders are also used for webs of non-woven material. The object of the present invention is to provide an improved winder and an improved winding method in which important parameters of the winding operation can be effectively controlled.

BRIEF SUMMARY

The present invention relates to a winder for winding a web roll of a fibrous web such as paper or a web of non-woven material. In the context of this patent application, the term "web roll" is to be understood as a roll of a fibrous web such as paper or non-woven material, for example a paper roll. The inventive winder comprises two support rolls for supporting the web roll during reeling and a core shaft for winding the roll of paper or non-woven material. At each longitudinal end of the core shaft, there is a carrier chuck in which the core shaft is rotatably journalled. The inventive winder further comprises a frame in which the carrier chucks are arranged to be movable towards or away from the support rolls and a rider roll arranged to be capable of acting against the roll being wound, e.g. a paper roll or a roll of a non-woven material. The rider roll is carried by a rider roll beam which is arranged to be movable in the frame such that the rider roll can be moved towards or away from the support rolls. The winder also comprises at least one actuator for moving the rider roll beam towards or away from the support rolls and at least one load cell is arranged to detect the force between the rider roll and the roll of paper or -nonwoven material, i.e. the web roll. According to the invention, the winder also comprises at least one actuator for moving the carrier chucks of the core shaft independently of the rider roll beam and at least one load cell arranged to detect the force with which the carrier chucks act on the core shaft. The inventive winder also comprises a logic control system connected to the load cells such that the logic control system receives measured values for the force between the web roll and the rider roll and the force with which the carrier chucks act on the core shaft. The logic control system is programmed to calculate the diameter and weight of the web roll based on machine speed and an assumed thickness and basis weight of the fibrous web being wound. Furthermore, the logic control system is arranged to control the actuators for the rider roll beam and the carrier chucks. The logic control system is programmed to control movement of the carrier chucks and the rider roll beam such that the sum of the forces detected from the load cells and the force resulting from the calculated weight of the web roll corresponds to a set value for the force between the roll and the support rolls.

In preferred embodiments of the invention, at least two load cells are arranged to measure the force with which the carrier chucks act on the core shaft, including at least one load cell on each carrier chuck.

In preferred embodiments, at least two load cells are arranged to measure the force between the rider roll and the web roll, including at least one load cell placed at each axial end of the rider roll beam.

In embodiments of the invention, the carrier chucks and the rider roll beam are moved in relation to the support rolls based on the calculated value of the web roll diameter.

Suitably, the logic control unit may be programmed to calculate an expected value for the force between the rider roll and the web roll and an expected value for the force with which the carrier chucks act on the core shaft which expected force values are based on the calculated diameter of the web roll. The value of the web thickness (for example paper thickness) can then be recalculated if the measured force values deviate from the expected values.

The winder further may comprise, at each axial end of the rider roll beam and the core shaft, at least one threaded bar which extends in the direction of movement of the carrier chucks and the rider roll beam. The actuators for the carrier chucks and the rider roll beam may then be arranged on the threaded bar and comprise threaded pieces arranged to interact with the threaded bar to move the chucks and the rider roll beam towards or away from the support rolls.

The invention also relates to a method of winding a web roll (for example a paper roll or a roll of a non-woven material) in a winder which winder comprises two support rolls for supporting the web roll during reeling and a core shaft for winding the web roll, i.e. a core shaft upon which the web roll is wound. In the winder used in the inventive method, there is also, at each longitudinal end of the core shaft, a carrier chuck in which the core shaft is rotatably journalled and a frame in which the carrier chucks are arranged to be movable towards or away from the support rolls as well as a rider roll arranged to be capable of acting against the web roll. The winder also has a rider roll beam carrying the rider roll and the rider roll beam is arranged to be movable in the frame such that the rider roll can be moved towards or away from the support rolls. In the inventive method, the force with which the rider roll acts on the web roll is detected. According to the invention, the force with which the core shaft acts on the web roll is also detected and the weight of the web roll is continuously calculated based on the machine speed, given values for web thickness and basis weight, for example thickness and basis weight of a fibrous web. The resulting force from the rider roll, the core shaft and the weight of the web roll is continuously calculated and compared to a set desired value for nip force between the web roll and the support rolls. The purpose of this is to see if the calculated resulting force matches the set desired value for nip force between the web roll and the support rolls. When there is a deviation between the calculated resulting force and the set desired value, the carrier chucks and/or the rider roll beam is/are moved until the deviation is eliminated.

DETAILED DESCRIPTION OF VARIOUS EMBODIMENTS

Figure 1:
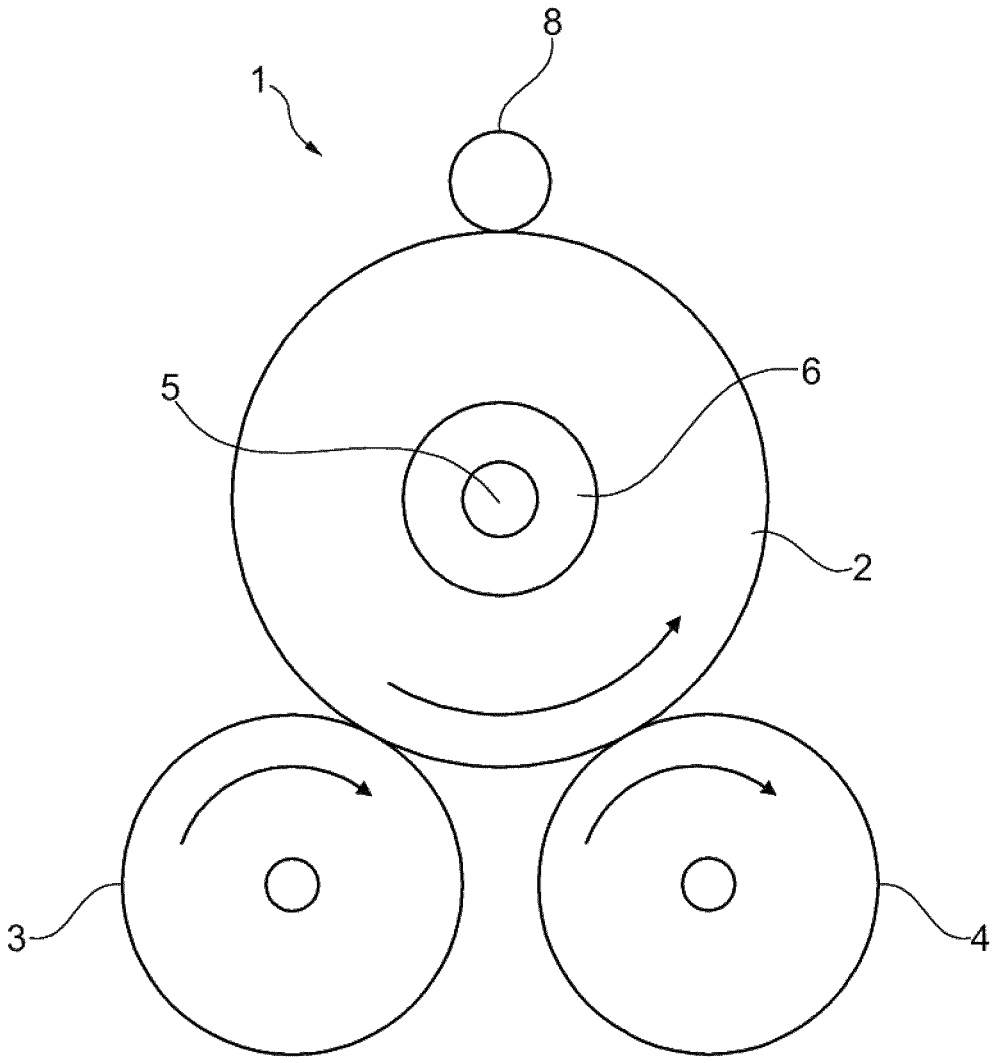
FIG. 1 is a side view giving a basic schematic representation of a winder with two support rolls, a rider roll and a web roll being wound.
Figure 2:
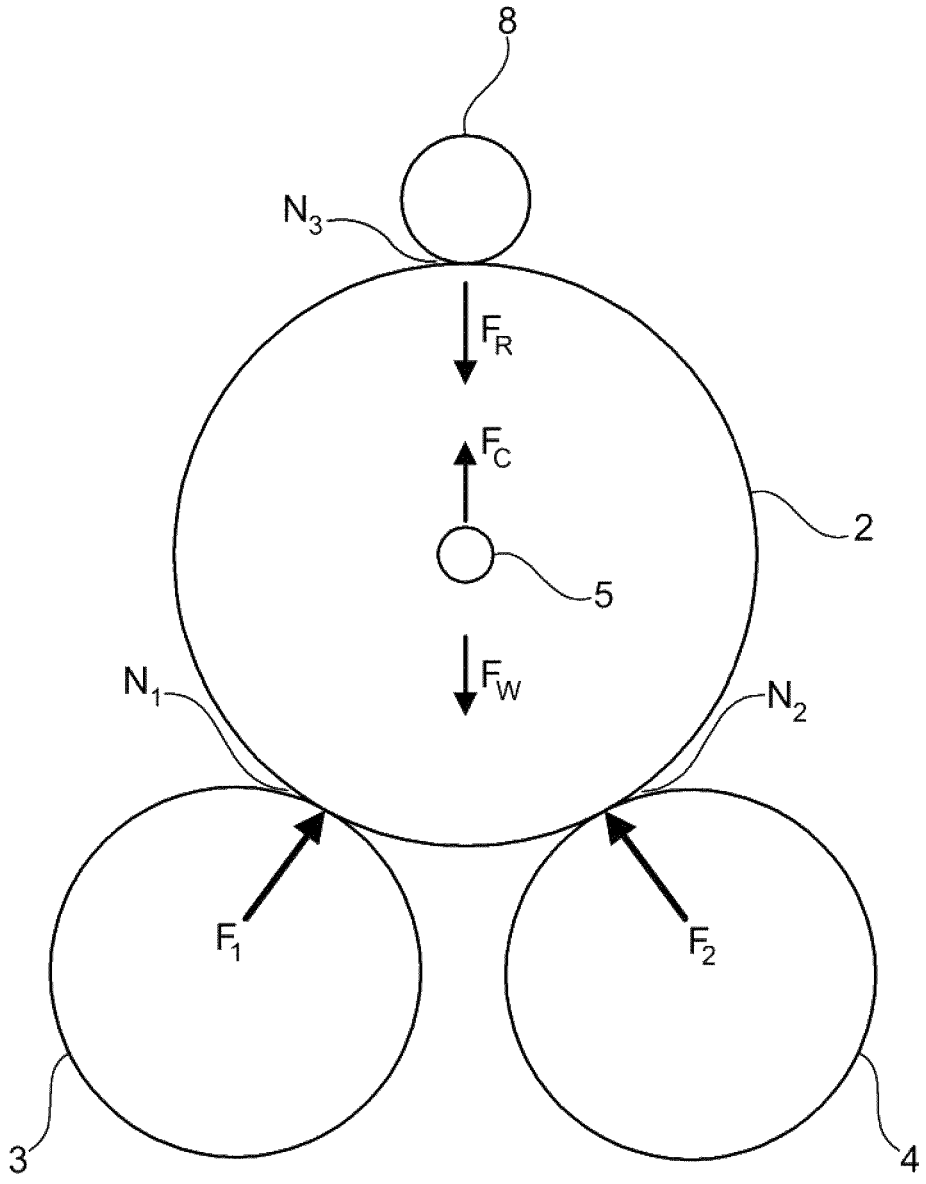
FIG. 2 is a schematic representation of the force balance in the winder.

With reference to FIG. 1, a winder 1 for winding a web roll 2 of a fibrous web is shown. The fibrous web may be a paper web such as a web of tissue paper having a basis weigh in the range of 15 g/m$^2$-40 g/m$^2$ but the invention can also be used for other fibrous webs. As can be seen in FIG. 1, the winder 1 comprises two support rolls 3, 4 for supporting the web roll 2 during reeling and a core shaft 5 for winding the web roll 2. A rider roll 8 is arranged to press against the side of the web roll 2 that is opposite the support rolls or support drums 3, 4. With reference to FIG. 2, it may be seen that the support rolls 3, 4 form nips $N_1$ and $N_2$ respectively with the web roll 2 that is being wound. The nip forces in the nips $N_1$ and $N_2$, i.e. the nip forces between the support rolls 3, 4 and the web roll 2, are indicated in FIG. 2 as $F_1$ and $F_2$ respectively. During winding, it is desirable that the forces $F_1$ and $F_2$ in the nips $N_1$ and $N_2$ can be kept at a predetermined desired value such that the result of the winding operation becomes satisfactory. The object of the present invention is to accomplish a winder in which these forces can be controlled. FIG. 2 also indicates the other forces acting on the web roll 2, including the force $F_R$ from the rider roll 8, the force $F_W$ from the weight of the web roll 2 itself and a force $F_C$ which will be explained further on. These forces will change as the web roll grows in size but will be in balance with each other.

Figure 3:
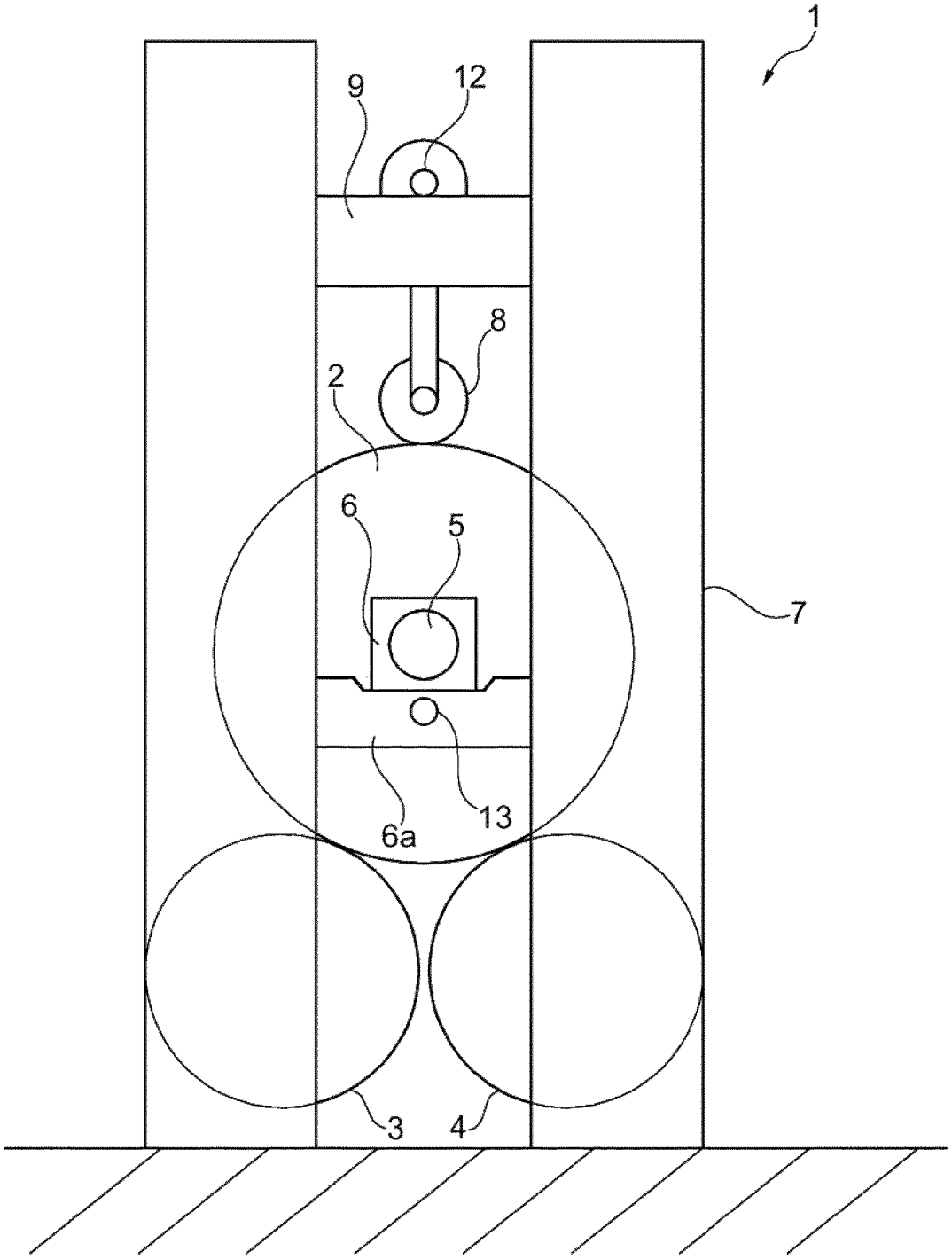
FIG. 3 is a view similar to that of FIG. 1 but also showing a frame, a carrier beam for a rider roll and chucks for a core shaft.

Reference will now be made to FIG. 3 in which it can be seen that the winder is placed in a frame 7. The rider roll 8 is arranged to be capable of acting against the web roll 2 that is being wound and is carried by a rider roll beam 9 that is preferably arranged to be able to slide in vertical guides in the frame (not shown in the figures) such that the rider roll 8 can be moved towards or away from the support rolls 3, 4. At each longitudinal end of the core shaft 5, there is a chuck 6 in which the core shaft 5 is rotatably journalled. Although only one side of the winder 1 chuck 6 is shown in the figures, it should be understood that the opposite side of the winder looks the same and that the same components would be present on the other side of the winder. The carrier chucks 6 are arranged to be movable towards or away from the support rolls 3, 4. In embodiments of the invention, the carrier chucks 6 have a support beam **6*a* which may be arranged to be able to slide in vertical guides in the frame 7**.

Figure 4:
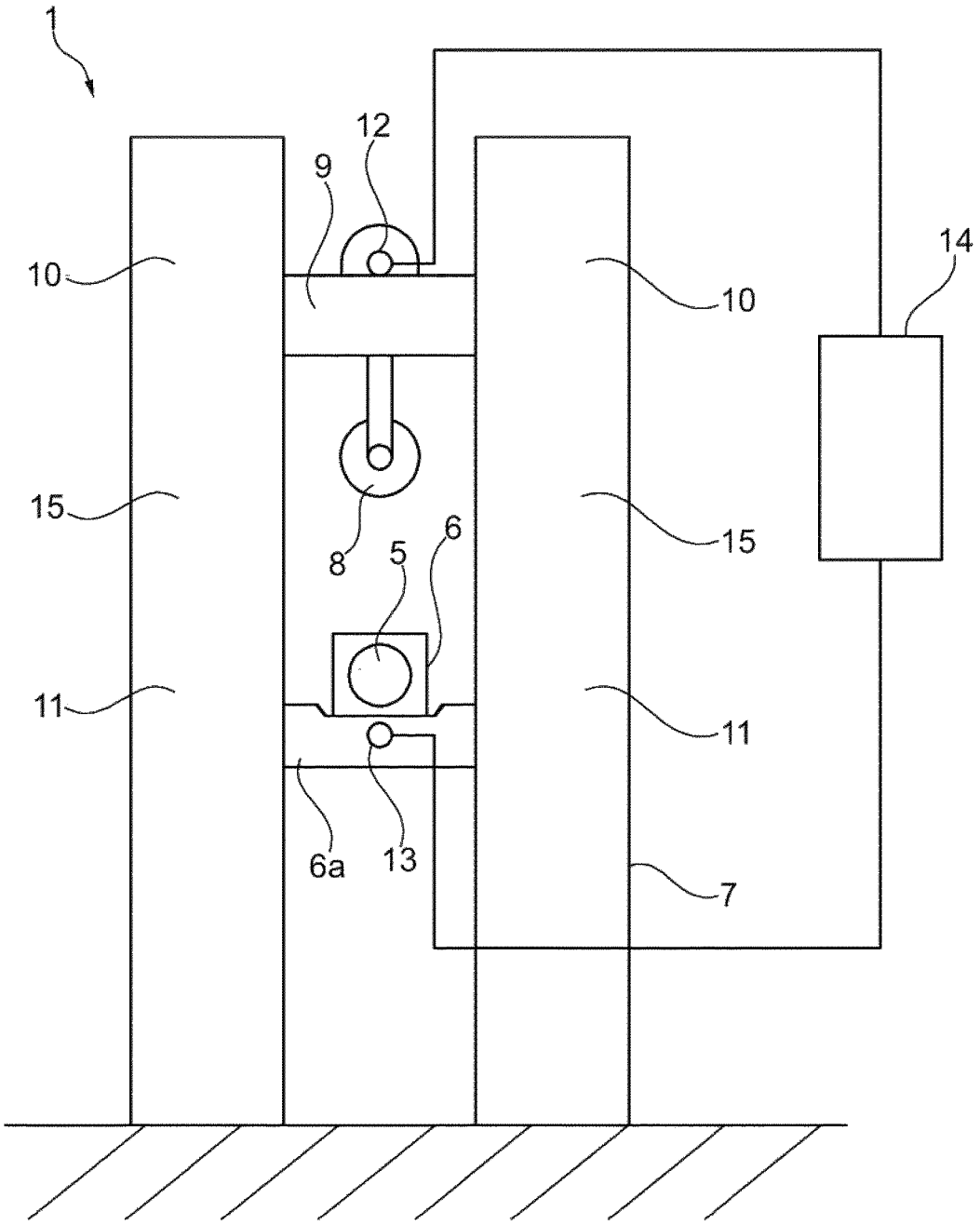
FIG. 4 is a view similar to FIG. 3 but with the support drums and the web roll removed to simplify the presentation of other components.

With reference to FIG. 4, the winder 1 comprises at least one actuator 10 which is capable of causing the rider roll beam 9 to move towards or away from the support rolls 3, 4 and at least one actuator 11 is arranged to be capable of moving the carrier chucks 6 towards or away from the support rolls 3, 4. The actuators 10, 11 for the rider roll beam 9 and the chucks 6 can act independently of each other as will be explained later with reference to FIG. 5.

As can be further seen in FIG. 3 and FIG. 4, there is at least one load cell 12 arranged to detect the force between the rider roll 8 and the web roll 2. In FIG. 3 and FIG. 4, the load cell is shown as being arranged on the rider roll beam 9 but it should be understood that it could be placed at some other place. At least one load cell 13 is also placed on the carrier chucks 6 and this at least one load cell 13 is arranged to detect a force with which the carrier chucks 6 act on the core shaft 5. In principle, embodiments are conceivable in which the load cells 12, 13 are placed on only one side of the winder but preferably, there is at least one load cell 13 at each axial ends of the core shaft 5 and at least one load cell 12 at each end of the rider roll beam 9. Embodiments are also conceivable in which only one load cell 12 is used for the rider roll beam 9 and such a single load cell might be placed at some point between the axial ends of the rider roll 8. Several load cells 12 could also be placed on the rider roll beam at different points along the axial extension of the rider roll 8.

With continued reference to FIG. 4, the load cells 12, 13 for the rider roll 8 and the carrier chucks 6 are connected to a logic control system 14 such that the logic control system 14 can receive measured values for the force between the web roll 2 and the rider roll 8 and the force with which the carrier chucks 6 act on the core shaft 5.

The logic control system 14 is programmed to calculate the diameter and weight of the web roll 2 based on machine speed and an assumed thickness and basis weight of the paper being wound. As will be further explained in the following, the logic control system 14 is arranged to control the actuators 10, 11 for the rider roll beam 9 and the carrier chucks 6. Furthermore, the logic control system 14 is programmed to control movement of the carrier chucks 6 and the rider roll beam 9 such that the sum of the forces detected from the load cells 12, 13 and the force resulting from the calculated weight of the web roll 2 corresponds to a set value for the force between the web roll 2 and the support rolls 3, 4. The logic control system 14 may suitably comprise a computer.

Figure 5:
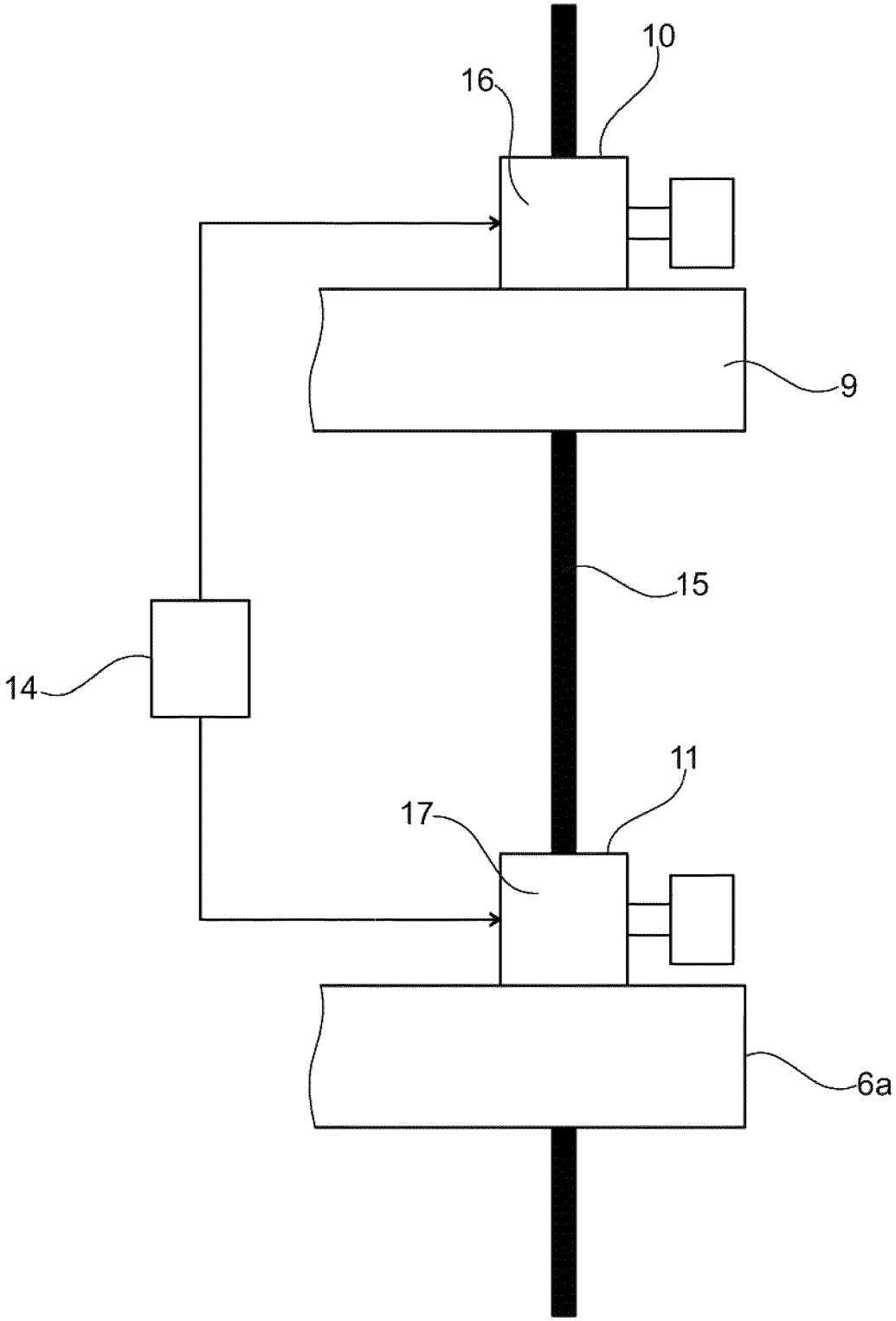
FIG. 5 is a schematic representation of a possible embodiments of an actuator arrangement for moving the rider roll and the core shaft.

Reference will now be made to FIG. 4 and FIG. 5 which shows one possible embodiment for realizing the actuators 10, 11 is schematically illustrated. A threaded bar 15 may be placed in the frame 7 and possibly fixed in the frame (or in some other object, for example the machine floor). The actuators 10, 11 may be comprise elements 16, 17 designed to interact with the threaded bar 15. For example, the elements 16, 17 may be elements having an internal thread that interacts with the threaded bar 15 such that rotation of the elements 16, 17 causes movement along the threaded bar 15. The actuators 10, 11 are fastened to/fixedly connected to the rider roll beam 9 and the support beam **6*a* for the chucks 6 and the actuators 10, 11 can be operated and controlled independently of each other such that the core shaft 5 and the rider roll 8 can be moved independently of each other. An arrangement as shown in FIG. 5 may be used on both sides of the winder 1, i.e. at each axial end of the core shaft 5 and the web roll 2**.

It should be understood that the actuator arrangement shown in FIG. 5 is only one possible embodiment of independently operable actuators 10, 11. Those skilled in the art to which the invention pertains can readily think of other possible actuators.

One alternative possibility that has been contemplated by the inventor is that instead of a fixed threaded bar 15 that is common to both actuators 10, 11, there could be separate threaded bars 15 for the rider roll beam 9 and the support beam 6*a* for the chucks 6. The rider roll beam 9 and the support beam 6*a* for the chucks can then be moved by rotation of the separate threaded bars. Since the threaded bars 15 would be separate, they can be rotated separately and interact with fixed elements 16, 17 such that the support beam 6*a* and the rider roll beam can be moved independently of each other. The embodiment with separate threaded bars 15 for the rider roll beam 9 and the support beam 6*a* is not shown in the figures but should be clear from the above explanation. In such an embodiment, the logic control system 14 may be arranged and programmed to control rotation of the threaded bars 15.

If an actuator solution using threaded bars 15 is used, there are thus at least two embodiments, one embodiment in which at least one threaded bar is common to both the actuator 10 of the rider roll beam 9 and the actuator 11 of the support beam 6*a*. This may be termed the "common threaded bar embodiment". The other embodiment is the embodiment in which there are separate threaded bars for the actuator/actuators 10 of the rider roll beam 9 and the actuator/actuators 11 of the support beam 6*a* and this embodiment may be termed the "separate threaded bar embodiment". In the common threaded bar embodiment, there may be two separate threaded bars on each side of the winder as indicated in FIG. 4, i.e. a total of four threaded bars 15. However, it would be possible to use only one threaded bar 15 on each side although two threaded bars (as shown in FIG. 4) is preferable since it gives better control. In the separate threaded bar embodiment, there may be four threaded bars on each side of the winder, i.e. a total of eight threaded bars 15.

The actuators 10, 11 could also take other forms. For example, they may be hydraulic cylinders or any other kind of actuator that can move the support beam 6*a* and the rider roll beam 9.

By means of the actuators 10, 11, the rider roll 8 and the chucks 6 and thereby also the core shaft 5 can be caused to act against the web roll 2 and subject the web roll 2 to forces. For example, the rider roll 8 can be pressed more or less against the growing web roll 2 which causes a force $F_R$ to act against the web roll 2 (see FIG. 2). In the same way, the core shaft 5 can, through movement of the chucks 6, be made to act on the growing web roll 2 with a force $F_C$ which may have a direction which is opposite to the direction of the force $F_R$ from the rider roll. In this way, lifting the carrier chucks 6 can relieve pressure from the web roll 2 against the support rolls 3, 4. Since the rider roll 9 can be moved independently of the core shaft 5, the nip force $F_R$ between the rider roll 8 and the web roll 2 may be controlled and varied independently which may be desirable in many practical applications.

Figure 6:
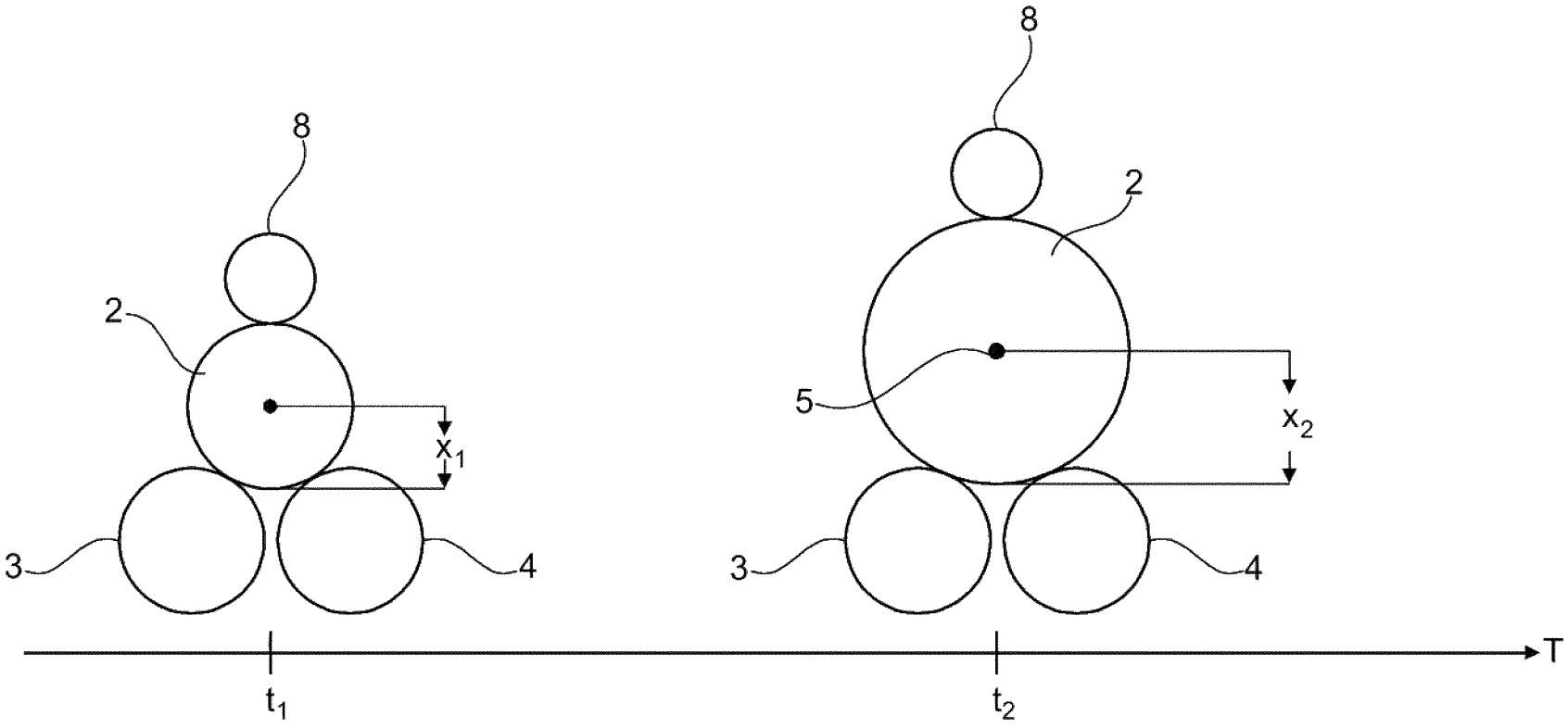
FIG. 6 is a schematic illustration of how the web roll grows in size over time.

During operation of the winder 1, the carrier chucks 6 and the rider roll beam 9 are moved in relation to the support rolls 3, 4 based on the calculated value of the web roll diameter. With reference to FIG. 6, it can be seen how the diameter of the web roll 2 increases over time. FIG. 6 illustrates, schematically, how the web roll 2 has a first size/diameter at the time $t_1$. As the winding operation continues, the diameter of the web roll 2 grows and at the time $t_2$, the diameter has increased. In FIG. 6, the radius is shown as "X" and it can be seen how the radius of the web roll has the radius $X_1$ at the point in time $t_1$ and how the radius has grown to $X_2$ at the point in time $t_2$. To compensate for this, the core shaft 5 and the rider roll 8 must be moved away from the support rolls 3, 4 as the web roll 2 grows. Since the core shaft 5 is located at the middle of the web roll 2 and the rider roll 8 at the upper surface of the web roll 2, the rider roll 8 must obviously move more than the core shaft. It should be noted that this movement would normally be a vertical movement and is indicated as such in the figures but embodiments are conceivable in which this would not necessarily be the case.

Figure 7:
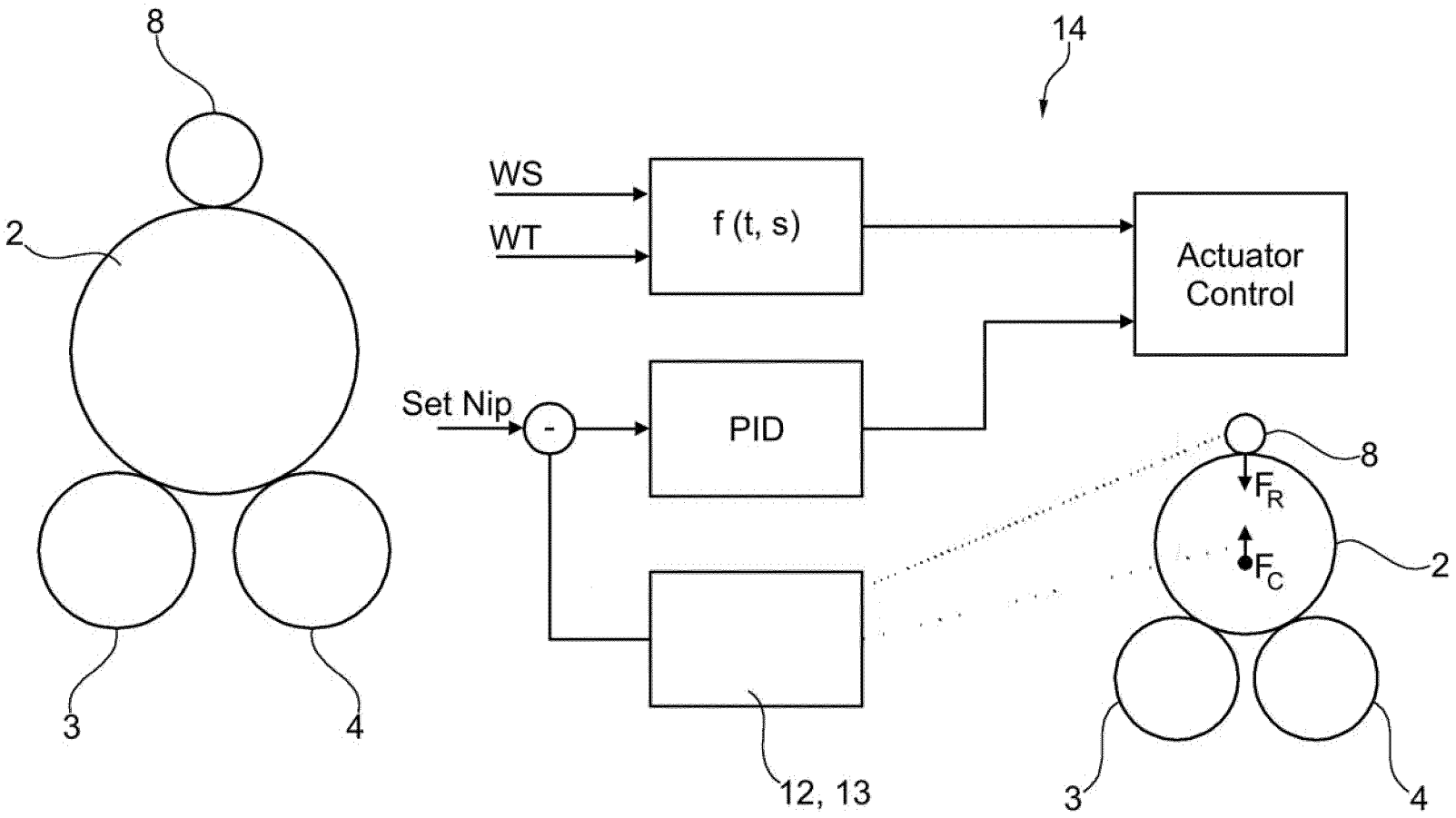
FIG. 7 is a schematic representation of a basic control loop which may be used in the present invention.

Reference will now be made to FIG. 7 in which a basic control loop for the logic control unit 14 is explained. Originally, a set desired value for the nip force $F_1$, $F_2$ between the support rolls 3, 4 and the web roll 2 is fed into the logic control system. The load cells 12, 13 transmit signals representing the actual values for the force with which the rider roll 8 acts against the web roll 2 and the force with which the core shaft 5 acts against the web roll 2.

With continued reference to FIG. 7, a given machine speed, i.e. a speed of the fibrous web is fed into the logic control unit. This speed is represented by arrow WS in FIG. 7. A given web thickness represented by arrow WT is also fed to the logic control unit 14. Although not shown in FIG. 7, it should be understood that basis weight of the fibrous web (i.e. grams per square meter) has also been fed into the logic control unit 14. Based on the given values for machine speed and thickness of the fibrous web, the logic control unit 14 is able to calculate continuously the diameter of the web roll 2 and also the weight of the web roll 2. Based on the calculated diameter of the web roll 2, the logic control unit 14 can send signals to the actuators 10, 11 and cause them to be activated to move the rider roll 8 and the core shaft 5 to fit their positions to the changing diameter of the web roll 2. The load cells 12, 13 send signals representing the actual forces $F_R$ and $F_C$ with which the rider roll 8*a* and the core shaft 5 act on the web roll 2. Based on these values, the logic control unit 14 can now calculate the weight of the web roll 2 and thereby also the force of gravity $F_W$ (see FIG. 2) emanating from the weight of the web roll 2 and which acts in a direction towards the support rolls 3, 4. The logic control unit can now compare the sum of the forces $F_R$, $F_C$ and $F_W$ according to the simple formula $F_R+F_W-F_C$ that should match the desired nip forces $F_1$ and $F_2$ between the web roll 2 and the support rolls 3, 4. Of course, the skilled person will be aware that the nip forces $F_1$, $F_2$ do not normally act in exactly the same plane as the forces resulting from the rider roll 8, the core shaft 5 and the weight of the web roll 2 and account has to be taken of the force components acting in the same plane as the forces $F_R$, $F_C$ and $F_W$. Since this is a question of basic mathematics well known to the skilled person, no detailed discussion of this aspect is needed.

If the logic control unit 14 finds that there is a deviation, i.e. that the forces $F_R$, $F_C$ and $F_W$ do not match the nip forces $F_1$ and $F_2$, the logic control system 14 will take correcting action. For example, if the logic control system determines that the sum of the forces $F_R$, $F_C$ and $F_W$ acting on the web roll is greater than it should be to match the set nip forces $F_1$ and $F_2$ for the nips $N_1$ and $N_2$, (see FIG. 2), the logic control system 14 will conclude that the nip forces $N_1$ and $N_2$ are above the set value. The logic control system 14 can then correct this by ordering the actuator(s) 11 to move the chucks 6 (and thereby the core shaft 5) in a direction away from the support rolls 3, 4 to relieve the nips $N_1$ and $N_2$ such that the nip forces $F_1$ and $F_2$ decrease. Alternatively, the actuator(s) 10 can be activated by the logic control unit 14 to move the rider roll 8 away from the support rolls 3, 4 (vertically upwards in the figures) such that the force from the rider roll 8 against the web roll 2 decreases. It is also possible that the logic control system 14 move both the rider roll 8 and the core shaft 5 away from the support rolls 3, 4 to reduce the nip forces between the web roll 2 and the support rolls 3, 4 until the set value for the forces $F_1$ and $F_2$ has been reached.

Similarly, if the readings from the load cells 12, 13 that reach the logic control unit 14 indicate that the sum of the forces $F_R$, $F_C$ and $F_W$ acting on the web roll 2 is smaller than it should be in order to match the set nip forces $F_1$ and $F_2$ for the nips $N_1$ and $N_2$, the logic control system 14 will conclude that the nip forces $N_1$ and $N_2$ are below the set value. This can be counteracted by, for example, ordering the actuator(s) 10 to move the rider roll 8 downwards towards the support rolls 3, 4 to increase the nip forces $F_1$, $F_2$ between the web roll 2 and the support rolls 3, 4. Alternatively—or in combination with such an order—the logic control unit 14 could order the actuator(s) 11 to move the core shaft 5 towards the support rolls 3, 4 until the readings from the load cells 12, 13 indicate that the set value for the nip forces $F_1$, $F_2$ between the web roll 2 and the support rolls 3, 4 has been reached.

Figure 8:
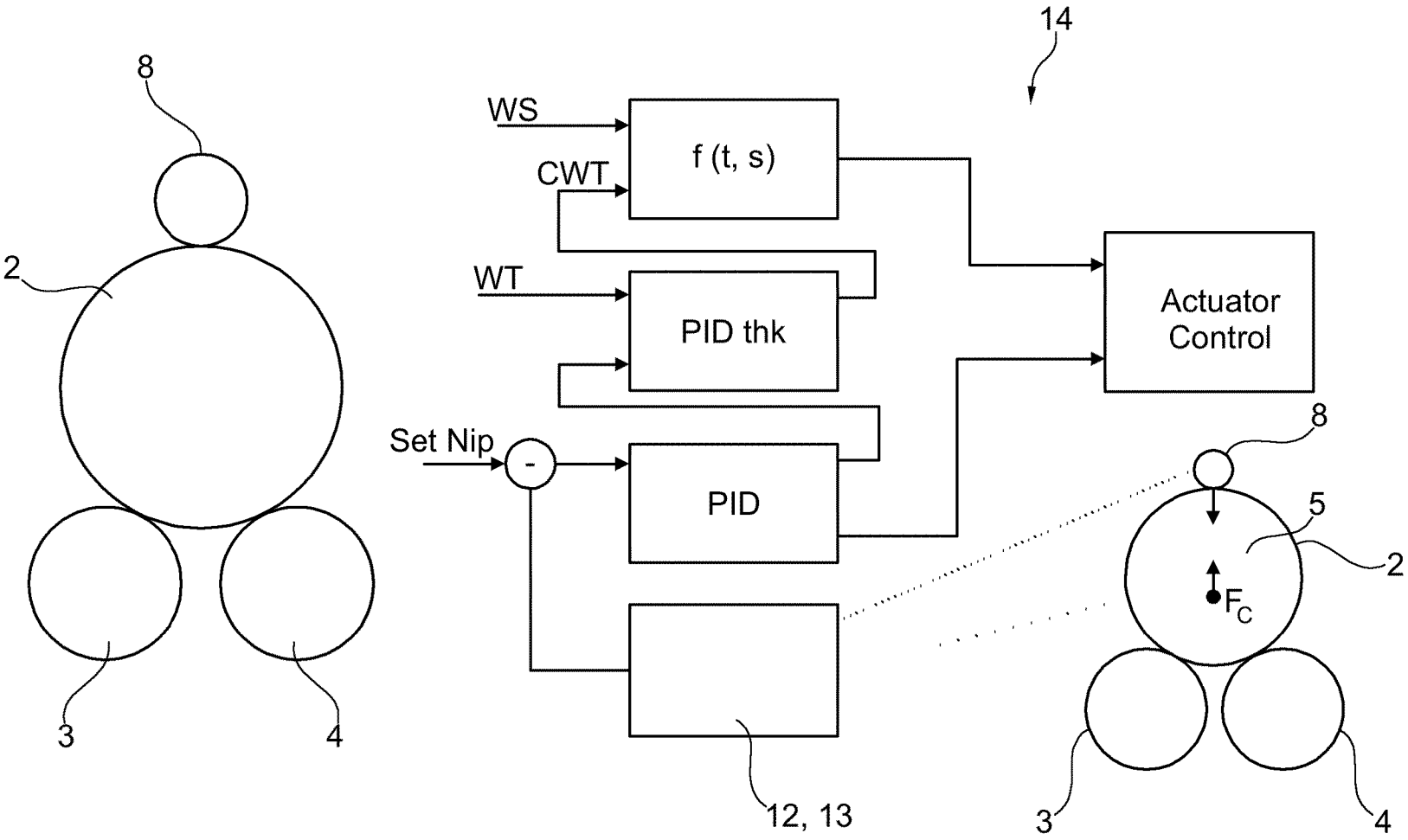
FIG. 8 is a schematic representation of another embodiment of a control loop which may be used in the present invention.

Reference will now be made to FIG. 8 in which a different control loop for the logic control unit 14 is illustrated. It may happen that the given value for web thickness is incorrect. In such cases, the actual diameter of the web roll 2 will not be what the logic control unit 14 has calculated. However, the logic control unit 14 that controls movement of the core shaft 5 and the rider roll 8 will know the actual position of the core shaft 5 and the rider roll 8 (since it controls their position). Therefore, the logic control unit 14 will also expect that the force readings from the load cells 12, 13 are within certain limits and will notice deviations. For example, if the thickness of the fibrous web is higher than the assumed value that has been fed to the logic control unit, the force reading from the load cell 12 will be higher than it ought to be which will generate an error. In the control loop of FIG. 8, the signal from the PID unit is not simply fed directly to the actuator control but also to the block unit indicated PID thk. If the signal fed to the unit PID thk indicates an error, this unit will recalculate the thickness value into a calculated thickness value CWT. The new thickness value CWT is then sent further such that a new functional value can be used in the processing. The logic control unit 14 can then continue to operate based on the new value for web thickness.

The logic control unit 14 is thus programmed to calculate an expected value for the force between the rider roll 8 and the web roll 2 and an expected value for the force with which the carrier chucks act on the core shaft 5 which expected force values are based on the calculated diameter of the web roll 2. The logic control unit can then recalculate the value of the web thickness if the measured force values deviate from the expected values.

While the invention has been described here in terms of a winder and a method of winding, it should be understood that the terms "winder" and "method of winding" only reflect different aspects of one and the same invention and that the method may include such steps that would be the inevitable result of operating the inventive winder, regardless of whether such steps have been explicitly mentioned or not.

Thanks to the invention, an effective control of the nip force between the web roll 2 and the support rolls 3, 4 can be achieved.

The invention claimed is:

1. A winder (1) for winding a web roll (2) from a fibrous web such as a paper web or a web of non-woven material, the winder (1) comprising:

two support rolls (3, 4) for supporting the web roll (2) during reeling;

a core shaft (5) for winding the paper roll (2);

at each longitudinal end of the core shaft (5), a carrier chuck (6) in which the core shaft (5) is rotatably journalled;

a frame (7) in which the carrier chucks (6) are arranged to be movable towards or away from the support rolls (3, 4);

a rider roll (8) arranged to be capable of acting against the web roll (2) being wound;

a rider roll beam (9) carrying the rider roll (8), the rider roll beam (9) being arranged to be movable in the frame (7) such that the rider roll (8) can be moved towards or away from the support rolls (3, 4);

at least one actuator (10) for moving the rider roll beam (9) towards or away from the support rolls (3, 4);

at least one load cell (12) arranged to detect the force between the rider roll (8) and the web roll (2);

at least one actuator (11) for moving the carrier chucks (6) of the core shaft (5) independently of the rider roll beam (9);

at least one load cell (13) arranged to detect the force with which the carrier chucks (6) act on the core shaft (5); and a logic control system (14) connected to the load cells (12, 13) such that the logic control system (14) receives measured values for the force between the web roll (2) and the rider roll (8) and the force with which the carrier chucks (6) act on the core shaft (5), wherein:

the logic control system (14) is programmed to calculate the diameter and weight of the web roll (2) based on machine speed and an assumed thickness and basis weight of the fibrous web being wound, the logic control system (14) is arranged to control the actuators (10, 11) for the rider roll beam (9) and the carrier chucks (6), and the logic control system (14) is programmed to control movement of the carrier chucks (6) and the rider roll beam (9) such that the sum of the forces detected from the load cells (12, 13) and the force resulting from the calculated weight of the web roll (2) corresponds to a set value for the force between the web roll (2) and the support rolls (3, 4).

2. The winder according to claim 1, wherein at least two load cells (13) are arranged to measure the force with which the carrier chucks act on the core shaft, including at least one load cell (11) on each carrier chuck.

3. The winder according to claim 1, wherein at least two load cells (12) are arranged to measure the force between the rider roll (8) and the web roll (2), including at least one load cell (12) placed at each axial end of the rider roll beam (9).

4. The winder according to claim 1, wherein the carrier chucks (6) and the rider roll beam are moved in relation to the support rolls (3, 4) based on the calculated value of the web roll diameter.

5. The winder according to claim 1, wherein the logic control unit (14) is programmed to calculate an expected value for the force between the rider roll (8) and the web roll (2) and an expected value for the force with which the carrier chucks act on the core shaft (5) which expected force values are based on the calculated diameter of the web roll (2) and recalculate the value of the web thickness if the measured force values deviate from the expected values.

6. The winder according to claim 1, wherein the winder further comprises, at each axial end of the rider roll beam (9) and the core shaft, at least one threaded bar (15) which extends in the direction of movement of the carrier chucks (6) and the rider roll beam (9) and in which the actuators (10, 11) for the carrier chucks (6) and the rider roll beam are arranged on the threaded bar (15) and comprise threaded pieces arranged to interact with the threaded bar (15) to move the carrier chucks (6) and the rider roll beam (9) towards or away from the support rolls (3, 4).

7. A method of winding a fibrous web into a roll (2) in a winder (1), the method comprising the steps of:

providing a winder (1) that comprises: two support rolls (3, 4) for supporting the roll (2) during reeling; a core shaft (5) for winding the web into a web roll (2); at each longitudinal end of the core shaft (5), a carrier chuck (6) in which the core shaft (5) is rotatably journalled; a frame (7) in which the carrier chucks (6) are arranged to be movable towards or away from the support rolls (3, 4); a rider roll (8) arranged to be capable of acting against the web roll (2) being wound; a rider roll beam (9) carrying the rider roll (8), the rider roll beam (9) being arranged to be movable in the frame (7) such that the rider roll (8) can be moved towards or away from the support rolls (3, 4);

detecting the force with which the rider roll (8) acts on the web roll (2);

detecting the force with which the core shaft (5) acts on the web roll (2);

continuously calculating the weight of the web roll (2) based on the machine speed, given values for web thickness and basis weight;

continuously calculating the resulting force from the rider roll (8), the core shaft (5) and the weight of the web roll (2);

comparing the resulting force to a set desired value for nip force between the web roll (2) and the support rolls (3, 4) to see if the calculated resulting force matches the set desired value for nip force between the web roll (2) and the support rolls (3, 4);

when there is a deviation between the calculated resulting force and the set desired value, moving at least one of the carrier chucks (6) or the rider roll beam (9) until the deviation is eliminated.

* * * * *